United States Patent [19]

Colwell et al.

[11] Patent Number: 5,017,302

[45] Date of Patent: May 21, 1991

[54] BAR SOAP HAVING IMPROVED RESISTANCE TO CRACKING

[75] Inventors: Dennis J. Colwell, East Windsor; James J. Pflug, Bordentown, both of N.J.

[73] Assignee: Colgate-Palmolive Company, Piscataway, N.J.

[21] Appl. No.: 393,934

[22] Filed: Aug. 15, 1989

[51] Int. Cl.[5] ..... C11D 9/26; C11D 13/10; C11D 13/18; C11D 17/02

[52] U.S. Cl. ..... 252/134; 252/174; 252/368; 252/369; 252/370; 252/DIG. 16

[58] Field of Search ..... 252/134, 174, DIG. 16, 252/367–370

[56] References Cited

U.S. PATENT DOCUMENTS

| | | | |
|---|---|---|---|
| 3,186,948 | 6/1965 | Sweeney | 252/161 |
| 3,766,097 | 10/1973 | Rosmarin | 252/552 |
| 4,014,807 | 3/1977 | Werner et al. | 252/132 |
| 4,234,464 | 11/1980 | Morshauser | 252/107 |
| 4,477,363 | 10/1984 | Wong et al. | 252/134 |
| 4,547,307 | 10/1985 | Hoppe et al. | 252/544 |
| 4,564,462 | 1/1986 | Watanabe et al. | 252/134 |
| 4,808,322 | 2/1989 | McLaughlin | 252/121 |

FOREIGN PATENT DOCUMENTS

| | | |
|---|---|---|
| 1213333 | 11/1970 | United Kingdom . |
| 2169612 | 7/1986 | United Kingdom . |

OTHER PUBLICATIONS

"Cracking of Toilet Soaps", *Soap and Chemical Specialities*, pp. 147–149.

*Primary Examiner*—Paul Lieberman
*Assistant Examiner*—A. Beadles-Hay
*Attorney, Agent, or Firm*—Robert Sullivan; Murray Grill; Richard J. Ancel

[57] ABSTRACT

A bar soap prepared from a tallow-coco soap chip base containing minor amounts of filler, dye and water and from 1 to 5 percent straight chain primary alcohol elected from the group consisting of stearyl alcohol, cetyl alcohol (1 hexadecanol) and myristyl alcohol, to reduce or eliminate wet cracking of the bar during use.

3 Claims, No Drawings

BAR SOAP HAVING IMPROVED RESISTANCE TO CRACKING

FIELD OF THE INVENTION

The present invention relates to a novel bar soap prepared from 60 to 85 percent tallow, 15 to 40 coco soap chip and 1.5–5% saturated long chain primary alcohol having from 16–18 carbon atoms in the molecule characterized by resistance to of wet cracking during use.

BACKGROUND OF THE INVENTION

The tendency of bar soap to form cracks when repeatedly moistened and dried during use is well known. This disturbing characteristic is particularly evident and bars containing a coloring agent. This tendency is undesirable in that it wastes soap and also gives a soap an unpleasant appearance during use. When bar soap is subjected to several cycles of washing and drying out it has a tendency to develop edge and face cracks. The soap color tends to bleed thus giving the soap an unpleasant appearance during use.

It has been found that addition of a straight chain primary alcohol which has 16–18 carbon atoms in the molecule, to a bar soap such as the 85% tallow 15% coco chip bar, containing a coloring agent, titanium oxide and water greatly reduces the tendency of the bar to crack during continuous cycle of wetting and drying out.

U.S. Pat. No. 4,014,807 to Werner et al describes washing agent based on synthetic detergents containing 1 to 10% branched chained alkanols in combination with di-octyl adipate. The product is characterized by a resistance to cracking during use.

U.S. Pat. No. 4,477,363 to Wong et al describes a buffered alkali earth metal surfactant bar containing 1–15% fatty alcohol that exhibits improved longevity and improved stability.

U.S. Pat. No. 3,186,948 to Sweeney describes detergent toilet bars that use polyhydric alcohols as binders in the soap formulation.

U.S. Pat. No. 3,766,097 to Rosmarin describes a composition useful for the manufacture of a detergent that contains from 5–15% of the polyhydric alcohol and beeswax.

U.S. Pat. No. 4,547,307 to Hoppe et al describes bar soap with deodorizing action in which one of the components is wood wax alcohol.

U.S. Pat. No. 4,234,464 to Morshauser describes a detergent bar containing a fatty alcohol as a binder.

SUMMARY OF THE INVENTION

It has been found that a bar soap based on 60 to 85 percent tallow 15 to 40 percent coco soap chip containing a coloring a titanium dioxide and sufficient water to provide about 10% water in the finally product can be made resistant to cracking during wetting, drying and rewetting cycles by adding 1–5% of a long chain primary alcohol, having 16–18 carbon atoms in the molecule, to the formulation.

Accordingly it is a primary object of the present invention to prepare a bar soap based on 60 to 85 percent tallow 15 to 40 percent coco soap chip which eliminates or substantially reduces the wet cracking tendency of the bar.

Another object of the invention that it provides bar soap based on 60 to 85 percent tallow 15 to 40 percent coco soap chip containing a dye and titanium dioxide which exhibits elimination or improvement in the cracking and coloring bleeding tendencies of the soap bar.

DETAILED DESCRIPTION OF THE INVENTION

Bar soaps, such as those based on tallow and coco soap chip are well known. The instant invention resides in the discovery that the addition of saturated long chain (16 to 18 carbon atoms in the molecule) primary alcohols to the formulation greatly reduces or eliminates wet cracking in the bar soap. The most important features of a long chain primary alcohol are 1. Single hydrogen bonding site per molecule. 2. Minimal solubility in water and 3. Saturated hydrocarbon chain. The preferred primary alcohol is stearyl alcohol. Cetyl(1-hexadecanol) can be substituted for the stearyl alcohol in the formulation. Examples of other suitable alcohols include Myristyl (1-Tetradecanol).

The present invention is an improvement over the prior art in that the process is simple and does not require new equipment and that a number of functional benefits can be achieved including improvement in reduction of cracking and color bleeding when the bars is used for some time and subjected to cycles of wetting drying and rewetting.

The first step in the process of preparing the bar is the selection of the base. The base containing 85% tallow and 15% coco soap chip is preferred however other conventional combinations of the ingredients that are used for bar soap manufacturer such as for example, 60% tallow and 40% coco soap chip can also be used. The bar soap formulation also contains from about 0.01 to 1.0% preferably 0.5% titanium dioxide 0.01 to 1.0% preferably 0.25% of a dye solution to impart color to the soap and 5.0 to 12.0% water in the final bar.

The long chain primary alcohols are added to the formulation containing the other ingredients. The other steps in the process are conventional. The ingredients are milled by three passes through a mill. In the first pass the water is added to break up the chip. The color, titanium dioxide and the long chain alcohol components are added in the second pass. The third pass insures the composition will be uniform.

The next step of the process the milled mixture is plodded. Any conventional plodder equipment can be used. A four inch plodder was used to allow for a larger batch and less finished soap variability. The mixture was plodded twice and extruded as a billet at a temperature of 100° F. The billets were formed in the extrusion step, cut to the desired length, and pressed into bar shape.

The invention is illustrated by the following specific but nonlimitating examples.

EXAMPLE 1

In this example a formulation was prepared to contain 89.64% of the 85% tallow 15% coco soap chip formulation. The soap chip was transferred to a mill and sufficient water was added in the first pass through to break up the chip to provide 10% moisture in the final product. The other ingredients, 0.28% color solution 0.08% titanium oxide and 5% stearyl alcohol were added after the stearyl alcohol was heated to 140°–145° F. The ingredients were mixed in the third pass in the mill to insure uniformity composition. The milled product was plodded in a four inch plodder to allow for larger batch and less finished soap variability. The plodded mixture was extruded at a temperature of a 100° F. and that the soap was cut into bars of the desired size and shape.

EXAMPLE 2

A control formulation was prepared identical to the formulation in example 1 except that no stearyl alcohol was added. The 85% tallow 15% coco soap chip component was 94.64% of the formulation. The water, titanium oxide and color solution were added using the techniques described in to Example 1. The mixture was milled, plodded and extruded using technique as described in Example 1.

EXAMPLE 3

The cracking properties of the product were evaluated by partially immersing bars water at 70° F. for four hours then allowing the bars to air-dry in a temperature and humidity controlled room, for 24 hours. The samples were then rated for edge and face cracks on a 0–5 scale, 0 representing no cracking. A total of 23 controls bars prepared according to the method of example 2 and 28 stearyl alcohol prototypes prepared according to the method described in Example 1 were evaluated. A statistical analysis of the test results performed using the functions of RSI, to establish validity of test. The following results were obtained.

TABLE 1

| TWO SAMPLE COMPARISION | |
|---|---|
| Control vs. Stearyl/Edge Cracks | $p < .05$ |
| Control vs. Stearyl/Face Cracks | $p < .05$ |
| The mean values and standard deviations are set out in Table 2 | |

TABLE 2

| MEAN VALUES AND STANDARD DEVIATIONS | X | SD |
|---|---|---|
| Stearyl Edge Cracks | 2.89 | 0.567 |
| Stearyl Face Cracks | 1.19 | 1.156 |

It is apparent from the data that the wet cracking characteristics of the bars are improved by the addition of stearyl alcohol to the formulation.

EXAMPLE 4

The aging characteristics of the products were evaluated. Samples of both control and stearyl alcohol bars were cartoned, foil overwrapped and stored at 110° F. for four weeks. All bars aged acceptably with no mold growth, off odors or significant color changes observed.

The invention has been described respect by examples and illustrations thereof but is not to be limited to these because it is evident that one skilled in the art, with the present specification before him would be able to utilize substitutes and equivalents without departing from the invention.

What is claimed is:

1. A bar soap which is resistant to wet cracking during use consisting essentially of about 60 to 85 percent tallow, 15 to 40 percent coco soap chip and 1.5 to 5 percent of a saturated straight chain primary alcohol of 16 to 18 carbon atoms in the molecule selected from the group consisting of stearyl alcohol, cetyl alcohol (1 hexadecanol) and myristyl alcohol.

2. A bar soap resistant to wet cracking during use consisting essentially of 60 to 85 percent tallow, 15 to 40 percent coco soap, 0.1 to 1 percent titanium dioxide, 0.01 to 1 percent dye, 5 to 12 percent water and about 1.5 to 5 percent of a straight chain primary alcohol of 16 to 18 carbon atoms selected from the group consisting of stearyl alcohol, cetyl alcohol (1 hexadecanol) and myristyl alcohol.

3. A process for manufacturing a bar soap based on tallow and coco bar chip consisting essentially of (a) adding about 1 to 5 percent straight chain stearyl alcohol, about 0.01 to 1 percent dye to 60 to 85 percent tallow, 15 to 40 percent coco soap chip together with sufficient water to prepare a soap bar containing about 5 to 12 percent water, (b) mixing the ingredients, (c) milling the mixture to ribbon form, (d) plodding the mixture, (e) extruding the plodded material into billet form, (f) cutting the billets to the desired length, (g) pressing the billets into bar shape.

* * * * *